United States Patent [19]

Hollowell et al.

[11] Patent Number: 5,074,716

[45] Date of Patent: Dec. 24, 1991

[54] OFFSHORE JACKET HAVING INCREASED BUOYANCY

[75] Inventors: James A. Hollowell, Northwood; William D. Hartell, London; Colin J. Billington, Maidenhead; E. Paul Shuttleworth, Camberley, all of England

[73] Assignee: Marathon Oil Company, Findlay, Ohio

[21] Appl. No.: 573,955

[22] Filed: Aug. 27, 1990

[30] Foreign Application Priority Data

Dec. 6, 1989 [GB] United Kingdom ..... 8927608

[51] Int. Cl.[5] ..... E02B 17/00

[52] U.S. Cl. ..... 405/227; 405/224

[58] Field of Search ..... 405/227, 203, 204, 195, 405/228, 224, 205

[56] References Cited

U.S. PATENT DOCUMENTS

| | | | |
|---|---|---|---|
| 3,524,322 | 8/1970 | Pogonowski | 405/227 |
| 3,858,801 | 6/1971 | Koehler | 405/227 |
| 4,014,176 | 3/1977 | Weidler, Jr. . | |
| 4,080,795 | 3/1978 | Weidler | 405/227 |
| 4,202,647 | 5/1980 | Lamy | 405/203 |
| 4,648,750 | 3/1987 | Horton | 405/208 |
| 4,721,417 | 1/1988 | Piazza et al. | 405/227 |
| 4,932,811 | 6/1990 | Folding | 405/227 |

*Primary Examiner*—Dennis L. Taylor

*Attorney, Agent, or Firm*—Jack L. Hummel; Jack E. Ebel

[57] ABSTRACT

An offshore submersible jacket assembly having bouyancy means at the lower portion of the jacket support legs. Relatively short pile sleeves are attached in a cluster to a support leg by shear plates extending generally along the length of the pile sleeves, each sleeve being connected to the leg by a pair of spaced shear plates. Upper and lower transverse plates seal off the ends of the spaced shear plates, creating airtight compartments.

9 Claims, 3 Drawing Sheets

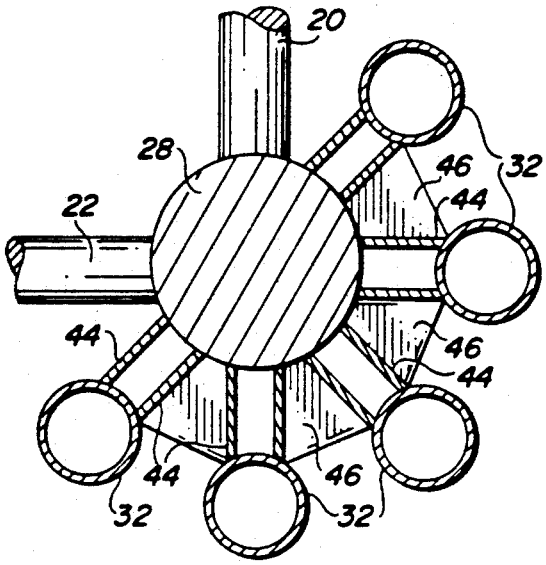
FIG. 4
FIG. 5
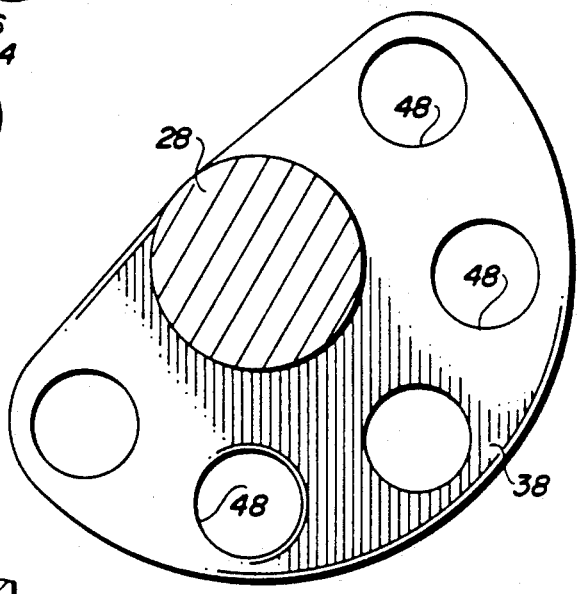
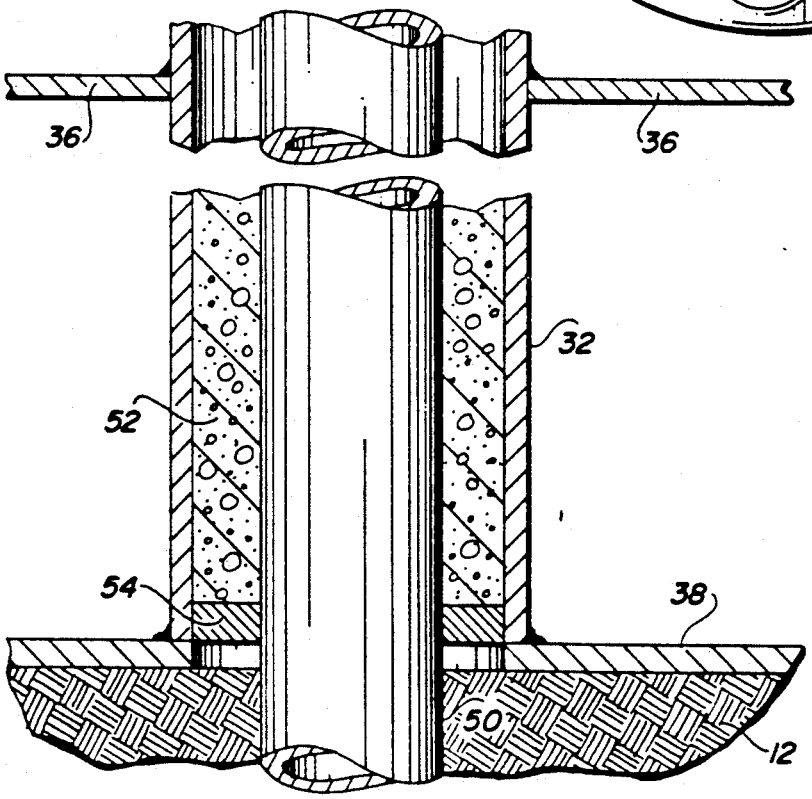
FIG. 7

OFFSHORE JACKET HAVING INCREASED BUOYANCY

FIELD OF THE INVENTION

This invention relates to offshore jacket assemblies commonly used to support a platform from which offshore oil production operations are conducted. More particularly, it relates to a jacket assembly having increased buoyancy properties.

BACKGROUND OF THE INVENTION

Offshore drilling platforms are typically supported by jackets having a number of legs which are anchored to the sea bed by piles. The jackets are necessarily quite massive, in order to support the platform and to resist the loads caused by waves, wind, currents and tides and by the impact of ships. The great weight of the jackets makes it more difficult, however, to transfer the jacket structure from the point of fabrication to the desired location in the water. As a practical matter some buoyancy of the jacket is required in order to more readily and accurately set the jacket in place on the sea bed.

As a result of the opposing requirements of great mass and buoyancy a large number of various jacket designs have been proposed. Some pertain to the type of jacket which an be fabricated in sections, with the sections being transported to the installation site and connected together there. These structures are often provided with various types of hollow support members which are flooded to provide the necessary ballast to lower the structure into place. Such structures, which can be quite complicated in esign, are generally limited in use to relatively calm waters, such as those encountered in the Gulf of Mexico.

Jackets utilized in rougher waters, such as those encountered in the North Sea, are required to be more massive due to the more severe forces to which the jackets may be subjected during use. Such jackets are more commonly fabricated in their entirety, then either lowered into place by cranes or launched from a transportation barge. Thus the problem caused by the great weight of the jacket becomes more acute, since the lift weight or launch weight is greater and the maneuverability of the jacket while placing it is reduced. For this reason, ways of reducing the weight and increasing the buoyancy of such jackets are constantly being sought.

In one form of jacket construction which makes use of relatively short pile sleeves located at the base of the legs for anchoring the jacket to the sea bed, it has been suggested to reduce the weight by shortening the length of the sleeves even more, theorizing that the lost strength resulting from shorter pile sleeves can be compensated by optimizing the grouted connection bstrength between the pile sleeve and the pile. It was found, however, that such an arrangement requires increased stress resistance in the connection between the jacket support leg and the pile sleeve. Thus both the pile sleeve and the usual shear plate which connects the support leg and the pile sleeve would have to be made thicker to provide greater stress resistance. Since the increased weight of the thicker plate metal would tend to offset the weight reduction achieved by shortening the pile sleeves it was not practical to so shorten the sleeves.

It has also been suggested to provide extra buoyancy to the jacket by constructing buoyancy chambers at the base of the support leg, such as disclosed in U.S. Pat. No. 4,014,176, wherein either foam or an airtight compartment is provided. That structure, however, requires the support leg to be entirely surrounded by the outer wall of the chamber, resulting in the introduction of significant extra weight which tends to offset the benefits of the added buoyancy. This design also requires more construction time and is more expensive to construct.

A simpler way of providing more buoyancy to a jacket without a complicated expensive design would be highly desirable, particularly if it also enables further savings in weight, such as, for exmaple, by permitting the shortening of the pile sleeves as discussed above. It is therefore a main object of the invention to provide additional buoyancy within the parameters mentioned.

BRIEF SUMMARY OF THE INVENTION

The invention briefly comprises a submersible offshore jacket assembly having a plurality of relatively long support legs, a plurality of relatively short pile sleeves adjacent a lower portion of at least one of the support legs, a plurality of spaced shear plates connecting each pile sleeve to the leg, and means for sealing the space between each pile sleeve, the support leg and the associated spaced shear plates at vertically spaced locations to form airtight compartments.

Preferably, the sealing means is in the form of upper and lower transverse plates connected to the pile sleeves, the support leg and the upper and lower end portions of the shear plates. The shear plates associated with each each pile sleeve preferably comprise a pair of plates which form the opposite side walls of an airtight compartment.

This arrangement permits the pile sleeves to be shortened, as discussed earlier, because the addition of an extra shear plate at each pile sleeve adds less weight than the alternative method of thickening both the single shear plate and the pile sleeves and because, in addition, it has the added benefit of adding considerably more buoyancy to the structure.

The above and other aspects of the invention, as well as other benefits, will readily be apparent from the more detailed description of the preferred embodiment of the invention which follows.

BRIEF DESCRIPTION OF THE DRAWINGS

FIG. 4 is a secitonal view taken along line 4—4 of FIG. 2;

FIG. 5 is a sectional view taken along line 5—5 of FIg. 2, showing a plan view of the lower plate of the pile sleeve cluster arrangement;

FIG. 7 is an enlarged partial longitudinal sectional view showing a pile extending through a pile sleeve.

DETAILED DESCRIPTION OF THE PREFERRED EMBODIMENT

Figure 1:
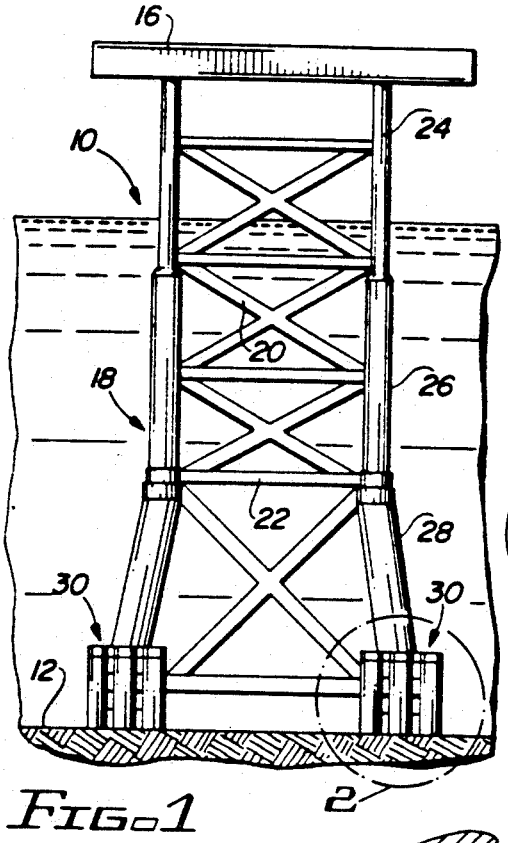
FIG. 1 is a side elevation of a submersible jacket incorporating the structure of the present invention.

Referring to FIG. 1, an installed jacket 10 is shown with its bottom portion being anchored to the sea bed 12 and its upper portion extending up above the water level to support a platform 16 which normally houses oil production equipmetn and facilities, not shown. The jacket comprises tubular legs 18 interconnected by suitable diagonal and horizontal braces 20 and 22, respectively. Each leg typically is comprised of sections of different diameer, with the upper section 24 being of lesser diameter than the intermediate section 26 and the lower leg section 28 being of greatest diameter. The manner of anchoring the jacket to the sea bed involves the use of a pile cluster 30 described in more detail below. It should be understood that while the jacket illustrated represents a suitable design which could be used in connection with the invention, other jacket designs could be used as well, provided, however, that the jacket is anchored by means of a pile cluster.

Figure 3:
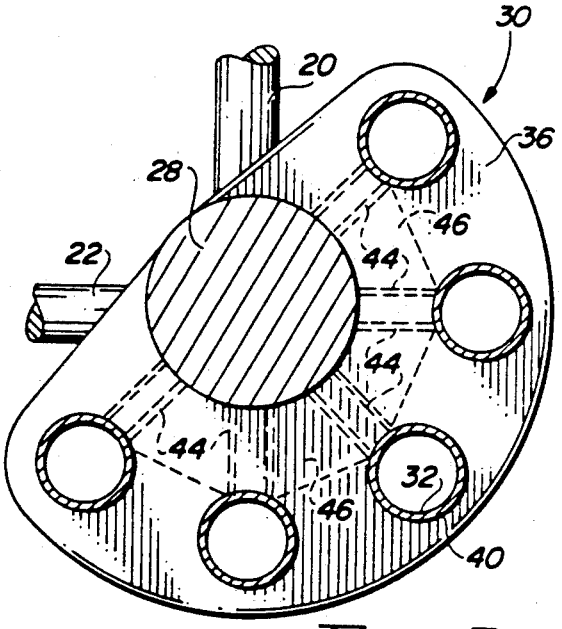
FIG. 3 is a sectional view taken along line 3—3 of FIg. 2, showing a plan view of the upper plate of the pile sleeve cluster arrangement.

Referring now to FIGS. 2, 3, 4 and 5, the pile cluster illustrated comprises five pile sleeves 32 spaced about a portion of the periphery of the support leg section 28. It will be understood that the particular pile sleeve arrangement shown is only for the purpose of illustrating the invention, and that other pile sleeve cluster arrangements could also be employed as long as the basic manner of providing added buoyancy, as described in more detail hereinafter, is utilized. The leg 28 is shown as being disposed at an angle to the vertical, which is typical of offshore jacket design, while the pile sleeves are substantially vertically aligned. The sleeves are held in place at their top and bottom portions by upper and lower transversely extending plates 36 and 38, respectively. As can be seen in FIG. 3, the upper portions of the sleeves extend through openings 40 in the upper plate 36 and, as illustrated best in FIG. 2, terminate in funnel-shaped guides 42 for facilitating the entry of a pile. Although not shown, the guides 42 may be further supported if desired by vertical stiffener plates disposed between the guides and the upper plate 36. Also, an extension or pile catcher plate may be attached to the guides 42, as is known in the art, to further facilitate entry of a pile into a pile sleeve.

Figure 2:
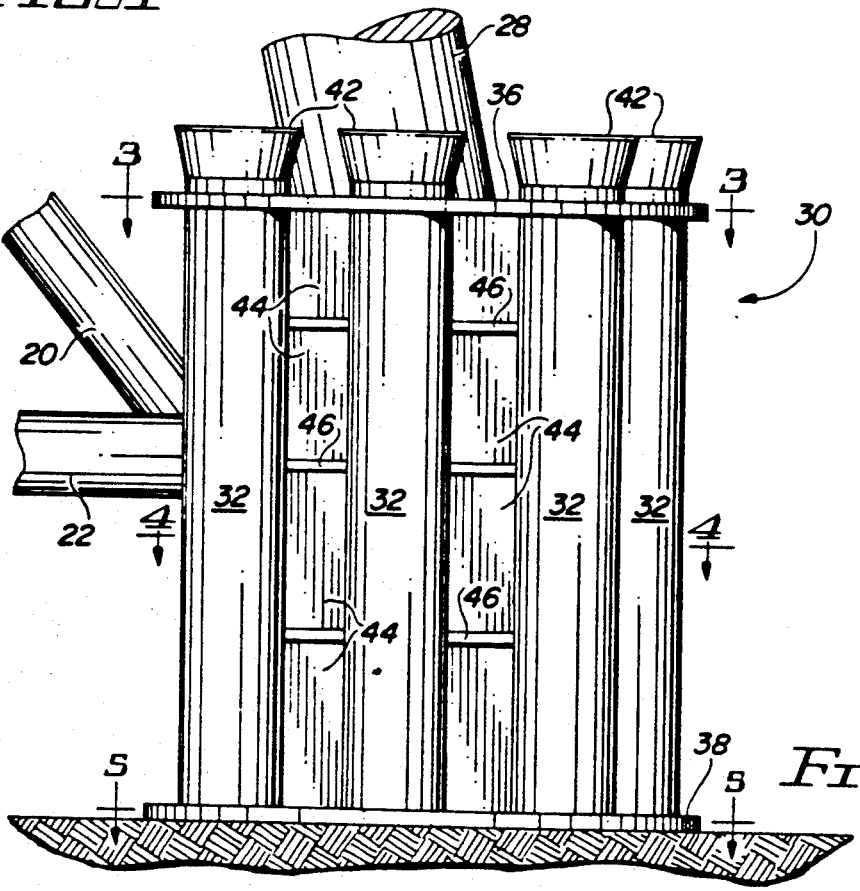
FIG. 2 is an enlarged side elevation of the cluster of pile sleeves located within the broken circle 2 of FIG. 1.

As shown by the dotted lines in FIG. 3 and by solid lines in FIG. 4, each pile sleeve 32 is connected to the jacket support leg 28 by a pair of spaced shear plate 44 as by welding or other means of attachment which provides an airtight connection. The shear plates 44 are shown in FIGS. 2 and 4 as being reinforced with vertically spaced stiffener plates 46 which extend between the sleeves 30 and 32 and the support leg section 28. The rigidity and resistance to stresses contributed by the pairs of shear plates is such that their thickness and the thickness of the pile sleeves can be significantly less than the thickness of shear plates and pile sleeves in a design incorporating only one shear plate between the support leg and each pile sleeve. The tops of the shear plates 44 terminate at the upper plate 36 and the bottoms of the shear plates terminate at the lower plate 38. By attaching the shear plates to the transverse plates 36 and 38 seal the space between each pair of shear plates and form with the sehar plates and the circumferences of the support leg and the associated pile sleeve an airtight compartment associated with each of the pile sleeves 32.

Figure 6:
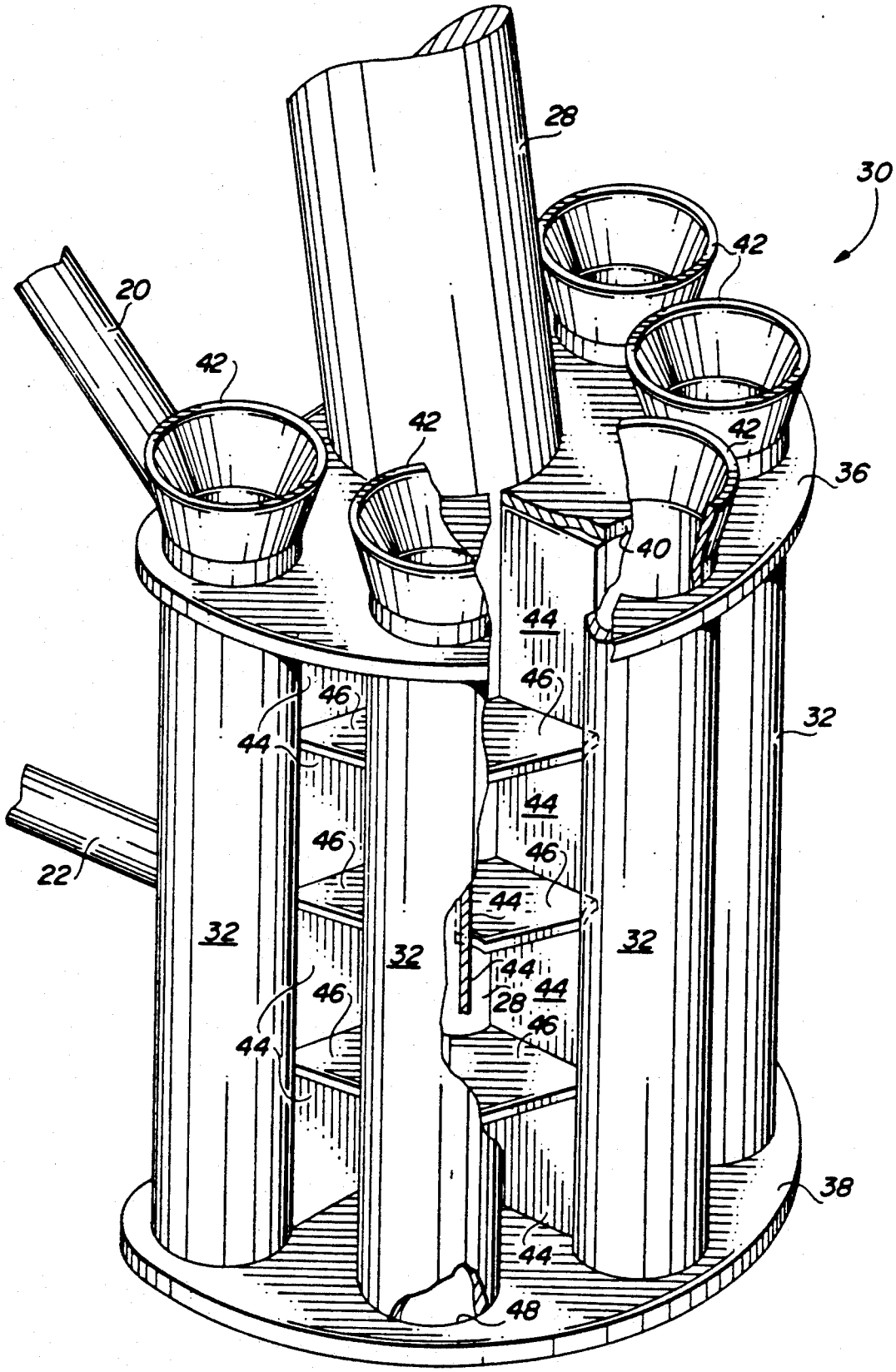
FIG. 6 is a partial pictorial view illustrating the structure which forms the airtight chambers associated with the jacket leg and each pile sleeve.

This arrangement is better illustrated in FIG. 6, wherein the pile sleeves 32 are shown as extending through the openings 40 in the upper plate 36 and the bottoms of the sleeves 32 are shown as being connected to the bottom plate 38. The tops of the plates 44 are attached to the upper plate 36 and the bottoms of the plates 44 are attached to the bottom plate 38. The shear plates associated with adjacent pile sleeves 32 are connected by the horizontal stiffener plates 46. The space defined by each pair of shear plates 44, the upper plate 36, the lower plate 38 and the circumferences of the leg 28 and sleeve 32 between the plates thus forms an airtight compartment between the pile sleeve and the support leg. With each pile sleeve being so constructed, the compartments add considerable buoyancy to the structure.

After the structure is in place, piles are driven through the pile sleeves and into the sea bed to anchor the jacket. This is illustrated in FIG. 7, which shows a pile 50 extending through the pile sleeve 32 down into the sea bed 12. The pile is of course of a smaller diameter than the inside diameter of the pile sleeve to enable the pile to readily enter and move through the sleeve. The resultign annulus between the pile 50 and the inside surface of the sleeve 32 is filled with suitable grout 52 which is retained in place by packer 54 located adjacent the bottom portion of the sleeve. Although the etails have not been shown since they are not important to the invention, it will be understood that any conventional form of packer and grout introduction valve means may be employed to introduce and maintain the grout in place until it has set.

FIG. 7 also shows the plates 36 and 38 as being welded to the pile sleeve 32 to seal off the chamber at these locations. Similarly, welds between the shear plates and the top and bottom plates 36 and 38 and between the shear plates and the jacket leg make the chamber connections air tight.

Although the invention has been described in connection with a pile cluster associated with one of the support legs of the jacket, a similar arrangement obviously may be employed in connection with all of the support legs. Further, the number of pile sleeves associated with the support leg may vary.

It can now be appreciated that the invention provides a means for permitting the pile sleeves of a jacket anchoring cluster to be shortened, thereby reducing the weight of the assembly, by providing spaced shear plates which form side walls of airtight compartments. This arrangement not only provides added strength but also provides added buoyancy in an economical, efficient manner, thus facilitating and shortening the jacket installation time and eliminating the need to add separate buoyancy tanks.

It will be understood that although not shown, diaphragms may be employed to seal the pile sleeves 32 at their ends to provide additional buoyancy.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention, as defined in the appended claims.

What is claimed is:

1. A submersible offshore jacket assembly, comprising: a plurality of relatively long support legs;

a plurality of relativley short pile sleeves radially spaced from a lower portion of at least one of the support legs;

a plurality of spaced shear plates extending from each pile sleeve to said one leg, each shear plate extending generally along the length of its associated pile sleeve and along the length of the lower portion of said one leg; and means for sealing the space defined by each pile sleeve, said one leg and the spaced shear plates at vertically spaced locations to form airtight compartments for increasing the buoyancy of the jacket assembly.

2. The submersible jacket assembly of claim 1, wherein the plurality of spaced shear plates connecting each pile sleeve comprises a pair of spaced plates.

3. The submersible jacket assembly of claim 1, wherein the sealing means comprises upper and lower transverse plates extending from said one support leg to the pile sleeves.

4. The submersible jacket assembly of claim 3, wherein the upper transverse plate contains openings through which the upper portions of the pile sleeves extend, and wherein the lower transverse plate contains openings in communication with their associated pile sleeves.

5. The submersible jacket assembly of claim 3, wherein the upper and lower transverse plates are located at upper and lower end portions of the spaced shear plates.

6. The submersible jacket assembly of claim 1, wherien the are a plurality of pile sleeves adjacent a lower portion of each of the support legs of the jacket assembly.

7. The submersible jacket assembly of claim 1, including piles extending through the pile sleeves and into the sea bed, the diameter of the piles being less than the inside diameter of the pile sleeves to form an annulus therebetween, the jacket assembly further including grout disposed in the annulus.

8. In a submersible offshore jacket assembly comprising a plurality of relatively long support legs and a plurality of relatively short pile sleeves adjacent a lower portion of at least one of the support legs, the improvement comprising:

a pair of spaced shear plates extending from each pile sleeve to said one leg, each shear plate extending generally along the length of its associated pile sleeve and along the length of the lower portion of said one leg; and upper and lower transverse sealing means for sealing the space defined by each pile sleeve, said one leg and the spaced shear plates at vertically spaced locations to form airtight compartments for increasing the buoyancy of the jacket assembly.

9. The improvement in an offshore submersible jacket assembly according ot claim 8, wherein the upper and lower transverse sealing means comprises transverse plates located at upper and lower end portions of each pair of spaced shear plates.

* * * * *

UNITED STATES PATENT AND TRADEMARK OFFICE

CERTIFICATE OF CORRECTION

PATENT NO. : 5,074,716

DATED : December 24, 1991

INVENTOR(S) : James A. Hollowell et al.

It is certified that error appears in the above-identified patent and that said Letters Patent is hereby corrected as shown below:

| | |
|---|---|
| Col. 1, line 33 | Delete "esign" and insert therefor --design--. |
| Col. 1, line 55: | Delete "bstrength" and insert therefor --strength--. |
| Col. 3, line 8: | Delete "equipmetn" and insert therefor --equipment-- |
| Col. 3, line 64: | After "38" insert --in an airtight manner, such as by welding, the plates 36 and 38--. |
| Col. 3, line 65: | Delete "sehar" and insert therefor --shear--. |
| Col. 4, line 24: | Delete "resultign" and insert therefor --resulting--. |
| Col. 4, line 27: | Delete "etails" and insert therefor --details--. |
| Col. 6, line 27: | Delete "ot" and insert therefor --to--. |

Signed and Sealed this

Thirtieth Day of March, 1993

*Attest:*

STEPHEN G. KUNIN

*Attesting Officer*

*Acting Commissioner of Patents and Trademarks*